United States Patent [19]

Focke

[11] 4,336,873

[45] Jun. 29, 1982

[54] APPARATUS FOR TRANSPORTING CIGARETTES FROM A SUPPLY STACK TO A PACKAGING MACHINE

[75] Inventor: Heinz H. Focke, Verden, Fed. Rep. of Germany

[73] Assignee: Focke & Co., Verden, Fed. Rep. of Germany

[21] Appl. No.: 160,894

[22] Filed: Jun. 19, 1980

[30] Foreign Application Priority Data

Jul. 21, 1979 [DE] Fed. Rep. of Germany ..... 2929660

[51] Int. Cl.[3] ..... B65G 1/00

[52] U.S. Cl. ..... 198/347; 414/403

[58] Field of Search ..... 198/347, 383, 435, 524, 198/527; 193/2 B; 53/148, 151; 414/403; 222/53, 197, 200; 221/157-160, 171, 172

[56] References Cited

U.S. PATENT DOCUMENTS 1,174,979 3/1916 Heiderich ..... 193/2 B 3,921,790 11/1975 Hinchcliffe et al. ..... 414/403 X

FOREIGN PATENT DOCUMENTS 2300526 9/1975 Fed. Rep. of Germany ..... 198/347

*Primary Examiner*—Robert B. Reeves

*Assistant Examiner*—Douglas D. Watts

*Attorney, Agent, or Firm*—Sughrue, Mion, Zinn, Macpeak and Seas

[57] ABSTRACT

Cigarettes 10 gravity discharged from a container supply stack 11 are transported by an elongated intermediate conveyor 12 to a funnel-like distribution chamber 16, and from then flow onto a transfer conveyor 27 in a main stream and into a buffer storage magazine 23 in a smaller stream. The magazine comprises a bidirectionally movable belt 24 having an angled endwall 25 mounted on it. A hinged sidewall 13 is repeatedly flapped against the cigarette ends by a roller driven cam 33 and follower 32 to evenly align them transverse to the direction of conveyance, and misaligned ones fall through lateral sideslots 37, 38 of the intermediate conveyor onto an angled deflection plate 39. Lightbeams 21, 22 in the distribution chamber monitor and control the level of the cigarette flow stream. The magazine is appropriately controlled for filling or discharge to maintain a constant output flow when the supply stacks are being changed.

9 Claims, 4 Drawing Figures

APPARATUS FOR TRANSPORTING CIGARETTES FROM A SUPPLY STACK TO A PACKAGING MACHINE

BACKGROUND OF THE INVENTION

The present invention relates to an apparatus for transporting cigarettes from a supply stack to a packaging machine.

It is customary to transport stacks of closely packed and aligned cigarettes coming from a rolling or filter-applying machine in special containers. Each container is usually delivered to a stacking station at which it is emptied.

As the cigarettes are pushed or conveyed away from the emptying stacks at regular intervals, it is necessary to equalize the cigarette flow so that the feeding process is continuous, i.e., takes place in a constant manner. To solve this problem cigarette transfer devices are known in which a magazine is formed in the same continuous plane as the transported cigarette stream, which accepts cigarettes while the stack is being emptied, and which discharges them again to maintain the transport stream when the stack has been completely emptied.

SUMMARY OF THE INVENTION

The present invention provides an apparatus for transporting cigarettes which are not continuously supplied, particularly from stacks, to a receiver which represents an improvement in relation to the functional capability, the dependability, and gentle handling of cigarettes. Such apparatus combines the following features:

(a) the magazine consists of an endless conveyor belt having a movable endwall attached to it, (b) the magazine is arranged below an intermediate conveyor in a plane parallel to it, and (c) a transfer conveyor extends horizontally and in the same plane as the magazine.

The stacking station according to the invention has a high storage capacity and a compact construction by reason of a limited structural height at optimal cigarette flow. The cigarettes are transferred by the stack to a relatively long intermediate conveyor. During this first longer conveyance period without upper limits for the cigarettes, they are arranged in the proper relative position and orientation. The cigarettes are thereby aligned transverse to the direction of conveyance, and misaligned ones are discharged to the side.

The relatively long transport distance of the intermediate conveyor enables a relatively high capacity and inexpensive cigarette magazine to be constructed as a belt magazine, namely as a conveyor belt with an endwall moving back and forth with it and mounted on it.

A cigarette distribution chamber formed adjacent to the intermediate conveyor defines a flow path, limited by the end of the intermediate conveyor, into the lower-lying cigarette plane. Below this path lies, somewhat centrally in relation to the path, the mutually confronting ends of the magazine belt and the transfer conveyor. The cigarette flow out of the distribution chamber occurs accordingly in part directly onto the transfer conveyor and in part into the magazine, i.e., while the stack is being emptied. In the distribution chamber measurements of the cigarette level or the height of the cigarettes are carried out such that when a certain minimum amount has been reached, for example due to momentary machine stoppage on the supply side, the device is shut off. Similarly the maximum level of cigarettes is monitored, also with the possible result of shutting the machine off.

DETAILED DESCRIPTION OF THE PREFERRED EMBODIMENT

Figure 1:
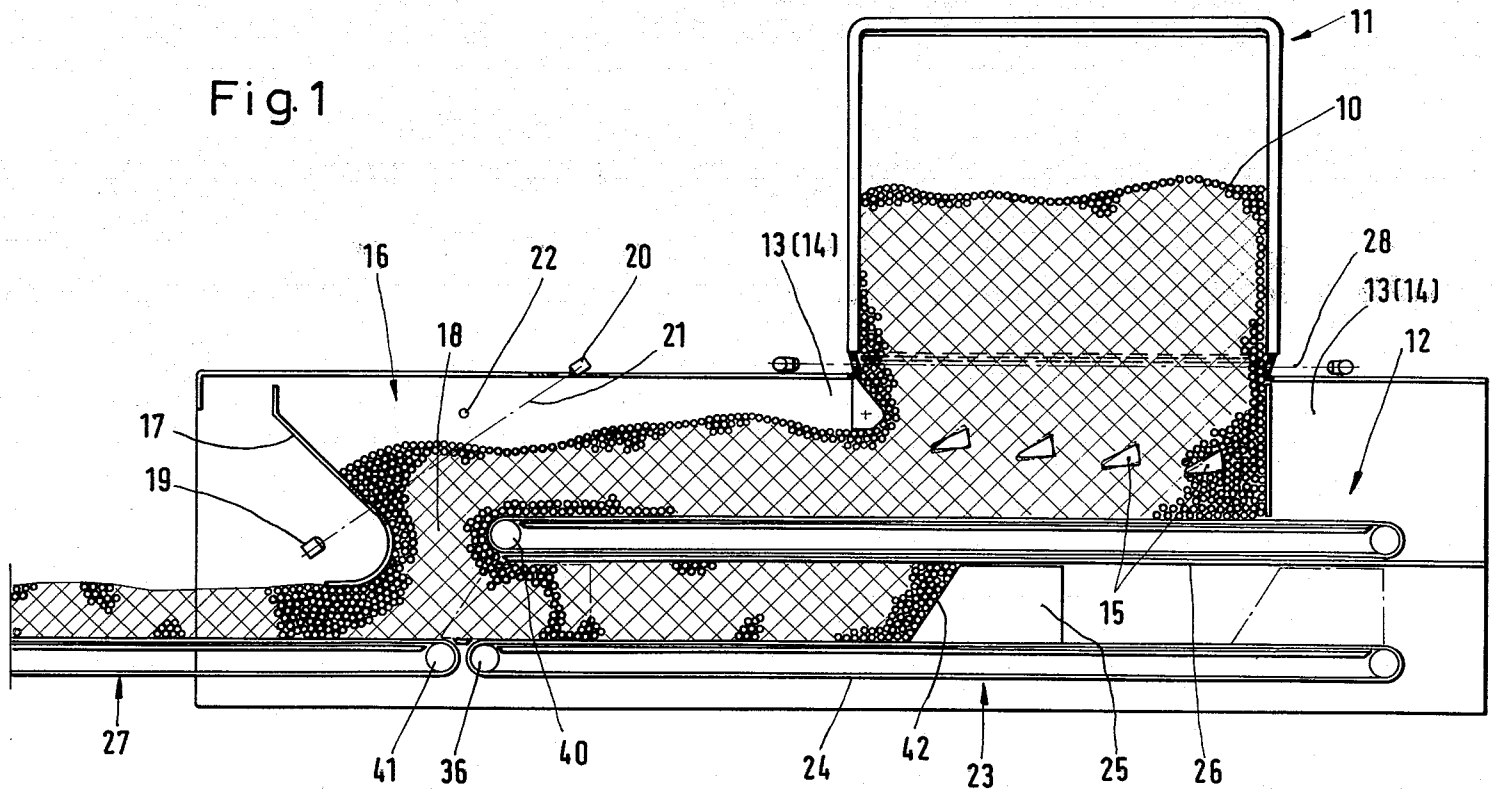
FIG. 1 shows a schematic side view of an apparatus for removing cigarettes from a stack and for transporting them further.
Figure 2:
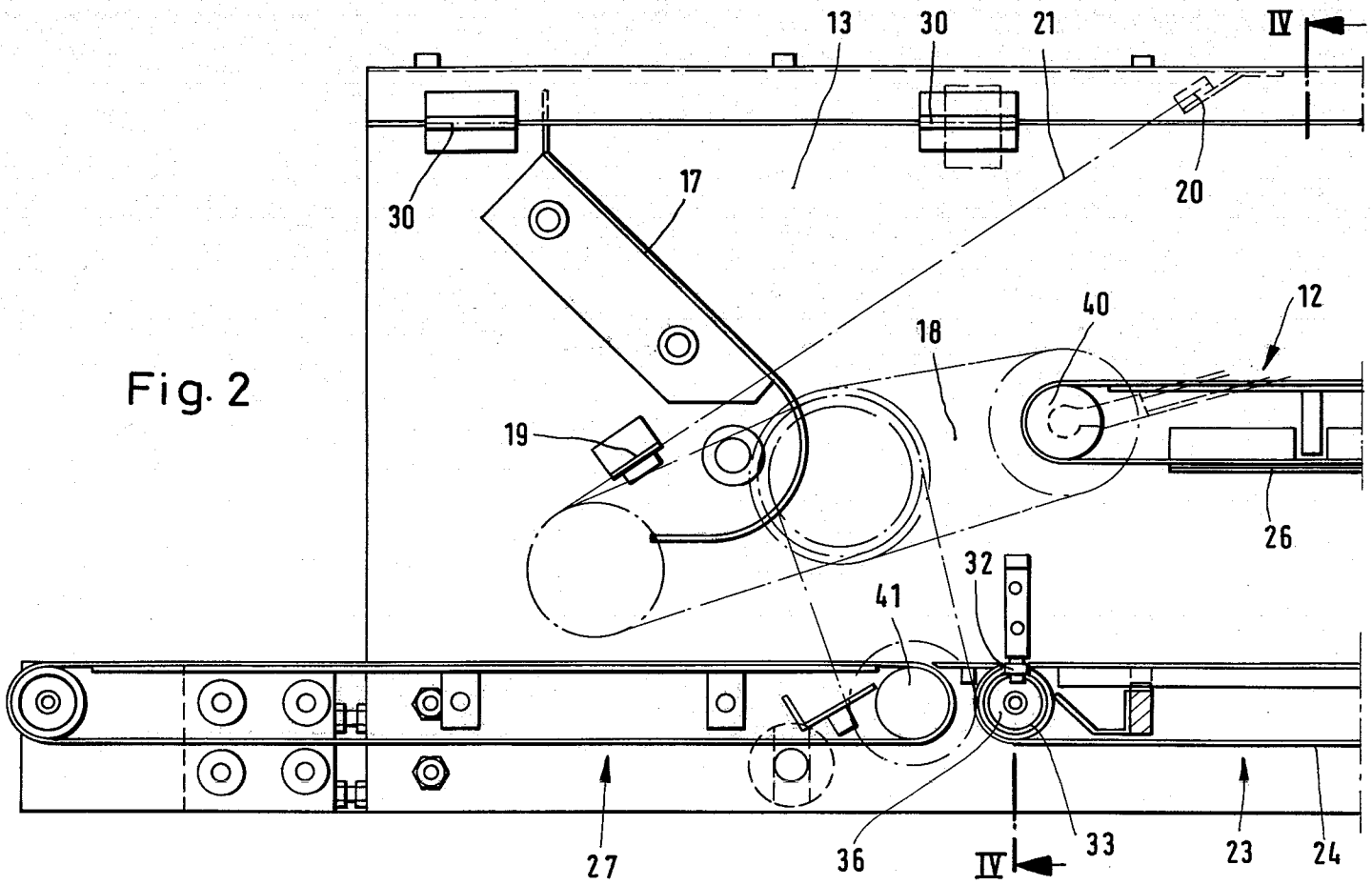
FIG. 2 shows a partial side view of the apparatus according to FIG. 1, in larger scale.

Referring now to the drawings, a stack 11 filled with cigarettes 10 is manually or mechanically transported and arranged so that the cigarettes can flow out from the bottom of the stack.

An intermediate conveyor 12 in the form of an endless belt is located inside the apparatus below the stack 11. The cigarettes 10 are taken up by the upper surface of the intermediate conveyor 12 and are transported to the left in FIG. 1. Above the intermediate conveyor 12 movable rocker bodies 15 with triangular cross-section are arranged between sidewalls 13 and 14 to assure the orderly flow of cigarettes in this area.

The intermediate conveyor 12 forms a relatively long conveyor path joining the area of the stack 11. At the end of the intermediate conveyor is a distribution chamber 16 for the cigarettes 10. The distribution chamber is limited on the side opposite the end of the intermediate conveyor by a funnel wall 17 arranged at an angle toward the bottom such that in the area between the turning point of the intermediate conveyor and the funnel wall a narrow passage 18 is formed. This is limited on the side opposite the funnel wall 17 by the end of the intermediate conveyor around deflection pulley 40.

The distribution chamber 16 has several objects. Monitoring devices are located in this area for monitoring the amount of cigarettes available, e.g., a light barrier 21 formed by transmitter 19 and receiver 20 extends along a diagonal plane at an angle through the cigarettes. This light barrier serves to control the minimum level of the cigarettes 10 in the distribution chamber 16. If the light barrier 21 remains broken by exceeding the minimum level the device remains in operation; otherwise it is shut off.

A light barrier 22 with a corresponding function is installed across the device from sidewall 13 to sidewall 14. This controls the maximum allowable cigarette level within the distribution chamber at a suitable location, with the result that by interrupting the light barrier 22 the supply of cigarettes is interrupted.

Below the intermediate conveyor 12 a buffer storage magazine 23 is formed. This consists of a magazine belt 24, movable back and forth, and an endwall 25 located on it. The latter is movable back and forth between the end positions shown in dotted lines in FIG. 1 while simultaneously forming a correspondingly larger magazine aarea to receive the cigarettes 10. The upper limit of this magazine area is an upperwall 26 directly below the intermediate conveyor 12.

A transfer conveyor 27 lies in the plane of the magazine belt 24 as an extension thereof. It transports the cigarettes in a horizontal plane to a packaging machine (not shown) or the like.

The device described up to this point operates such that after the stack 11 has been emptied the intermediate conveyor 12 is immediately shut off to avoid further lowering the cigarette level in this area. To this end the cigarette level directly below the stack 11 is monitored by a transverse or horizontally oriented light barrier 28.

During the shut down phase of the intermediate conveyor 12 the cigarettes are removed from the filled magazine 23 by moving the endwall 25 towards the transfer conveyor 27. Cigarettes thus return into the distribution chamber until a maximum level monitored by the light barrier 22 has been reached.

After a fresh stack 11 has been put in place, the intermediate conveyor 12 is started up again. Now the quantity of cigarettes being introduced is greater than the transport capacity of the transfer conveyor 27. Thus, a portion of the cigarettes leaves the distribution chamber 16 directly onto the transfer conveyor 27. Another portion is moved into the magazine 23 and the endwall 25 is simultaneously moved away. The magazine 23 can thus be filled to its maximum capacity. The magazine can be emptied, according to the outflow level, continually or discontinually, i.e., while the end wall 25 is temporarily at a standstill in an intermediate position.

Figure 3:
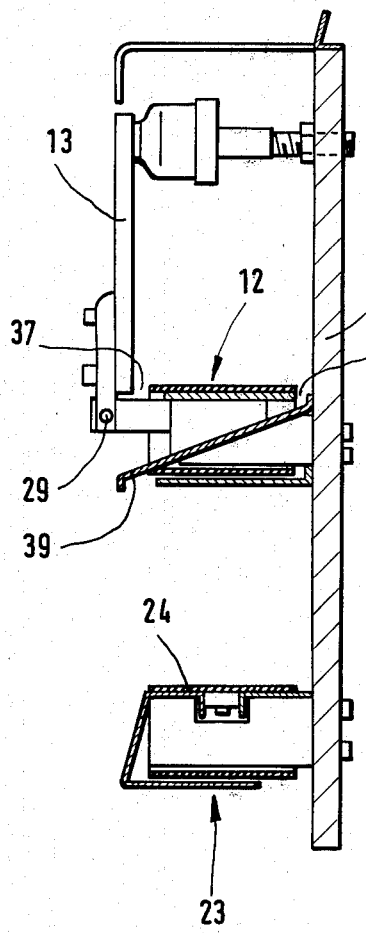
FIG. 3 shows a cross-section through the apparatus in the scale of FIG. 2.
Figure 4:
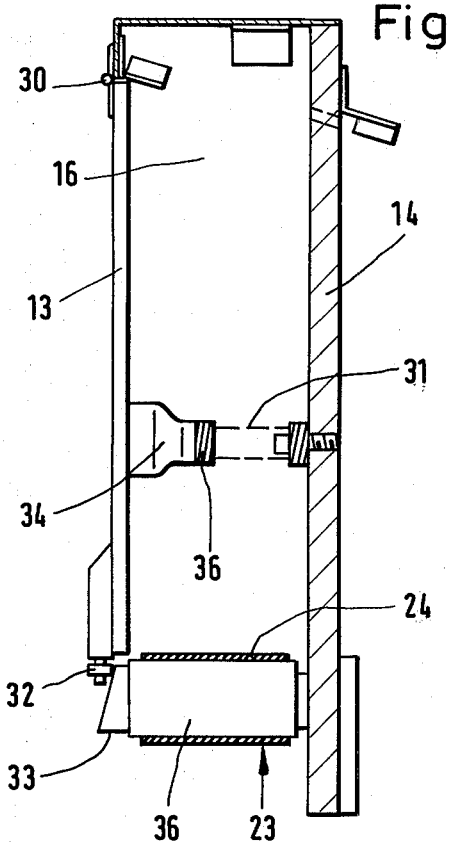
FIG. 4 shows a cross-section along line IV—IV in FIG. 2.

The area above the intermediate conveyor 12 including distribution chamber 16 is limited on the sides by sidewalls 13 and 14. Sidewall 14 is formed as a load bearing structural member and is connected to a machine frame or the like. The opposite sidewall 13 is divided into two sections. In the area below the stack 11 only the area above the intermediate conveyor 12 is limited by the sidewall 13, as seen in FIG. 3. The magazine 23 here is without a limit on the side opposite sidewall 14. In the area of the distribution chamber 16 the sidewall 13 extends over the entire height, thus including magazine 23 (FIG. 4).

The sidewall 13 in the area outside the distribution chamber 16 is mounted on hinges 29 (FIG. 3). In the area of the distribution chamber the sidewall 13 is mounted on an upper hinge 30. The sidewall 13 here is given a pulsating pivotal motion so that the cigarettes 10 align themselves within the distribution chamber. To this end the sidewall 13 is under tension of a spring 31 which connects the two sidewalls 13, 14 to one another. A return roller 32 is mounted at the bottom edge of the sidewall 13 and makes contact with a circular curved cam 33 whose rotation causes the pivotal pulsation of the sidewall 13. The cam 33 is mounted on a deflection roller 36 for the magazine belt 24 and is rotationally driven therewith.

The spring 31 is connected to a magnet 34 on the sidewall 13 by a metal piece 35. The strength of the magnet maintains the connection during pulsating movement against the return force of the spring. The entire sidewall 13 can be pivoted or swung out to open the chamber by manually removing the magnet 34.

In order to cull out cigarettes not properly aligned transverse to the transport direction, i.e., lying unorganized, sideslots 37, 38 are formed in the lateral areas of the intermediate conveyor 12, and extend in the transport direction. The misaligned cigarettes fall through these sideslots onto an angled deflection plate 39.

The relative position of the three conveyors to each other or in relation to the distribution chamber 16 is of particular importance. The ends of the magazine 23 and the transfer conveyor 27 at the deflection rollers 36, 41 are directed towards each other and lie in the area of the flow passage 18 as shown in FIG. 1, moved slightly out of the central vertical plane in the direction of the magazine 23. The magazine belt 24 and transfer conveyor 27 lie essentially in a common horizontal plane. The cigarette flow out of the distribution chamber 16 is deflected correspondingly by engaging the magazine. The largest part of the flow of cigarettes 10 progresses directly to the transfer conveyor 27.

The end wall 25 of the magazine 23 is provided with an angled end surface 42, which enables the magazine to be completely emptied. In its empty position (to the left in FIG. 1) the angled end surface 42 extends from the end of the intermediate conveyor 12 to the beginning of the transfer conveyor 27.

What is claimed is:

1. An apparatus for transporting cigarettes from a supply stack (11) to a packing machine, and including an intermediate conveyor (12) extending horizontally below the stack; a horizontal transfer conveyor (27) for transporting the cigarettes to the packing machine and a buffer storage magazine disposed before the transfer conveyor in the direction of cigarette flow to receive and discharge cigarettes depending on periodic fluctuation in their supply to thus maintain a constant output, characterized by:

(a) the magazine (23) comprising a belt (24) having an end wall (25) mounted on it and being movable back and forth, (b) the magazine being disposed below the intermediate conveyor in a plane parallel thereto, (c) the transfer conveyor being disposed in the plane of the magazine belt and comprising a horizontal extension thereof, (d) a distribution chamber (16) disposed at a discharge end of the intermediate conveyor from which the cigarettes are transportable via a downward passage (18) in partial streams to the transfer conveyor and to the magazine, both the transfer conveyor and the magazine having receiving ends disposed below the passage, (e) the distribution chamber being limited on the side opposite the discharge end of the intermediate conveyor by a funnel wall (17) converging downwardly, and (f) means for monitoring the cigarette level in the distribution chamber comprising a first light barrier (21) directed diagonally to the longitudinal axes of the cigarettes to detect a minimum level, and a second light barrier (22) running in the longitudinal direction of the cigarettes to detect a maximum level.

2. An apparatus according to claim 1, further comprising a distribution chamber (16) disposed at a discharge end of the intermediate conveyor from which the cigarettes are transportable via a downward passage (18) in partial streams to the transfer conveyor and to the magazine, both the transfer conveyor and the magazine having receiving ends disposed below the passage.

3. An apparatus according to claims 1 or 2, wherein the end wall of the magazine belt has an angled surface (42).

4. An apparatus according to claim 2, wherein the distribution chamber is limited on the side opposite the discharge end of the intermediate conveyor by a funnel wall (17) converging downwardly.

5. An apparatus according to claim 4, wherein the cigarette level in the distribution chamber is monitored by a first light barrier (21) directed diagonally to the longitudinal axes of the cigarettes to detect a minimum level, and by a second light barrier (22) running in the longitudinal direction of the cigarettes to detect a maximum level.

6. An apparatus according to any one of claims 1, 2, 4 or 5, wherein the areas for receiving cigarettes in the intermediate conveyor and the distribution chamber are limited by opposite sidewalls (13, 14), one of which is flappable in a back and forth pulsating manner against the ends of the cigarettes.

7. An apparatus according to claim 6, wherein said one sidewall (13) is hingedly mounted on its upper edge.

8. An apparatus according to claim 1, wherein edge slots (37, 38) are formed on the sides of the intermediate conveyor, are limited by the sidewalls (13, 14), and extend in the longitudinal direction of the intermediate conveyor, and below said slots a diverter plate (39) is mounted at a descending angle to discharge misaligned cigarettes falling through the slots.

9. An apparatus for transporting cigarettes from a supply stack (11) to a packing machine, and including an intermediate conveyor (12) extending horizontally below the stack, a horizontal transfer conveyor (27) for transporting the cigarettes to the packing machine and a buffer storage magazine disposed before the transfer conveyor in the direction of cigarette flow to receive and discharge cigarettes depending on periodic fluctuation in their supply to thus maintain a constant output, characterized by:

(a) the magazine (23) comprising a belt (24) having an end wall (25) mounted on it and being movable back and forth, (b) the magazine being disposed below the intermediate conveyor in a plane parallel thereto, (c) the transfer conveyor being disposed in the plane of the magazine belt and comprising a horizontal extension thereof, (d) edge slots (37, 38) formed on opposite sides of the intermediate conveyor, limited by sidewalls (13, 14) thereof, and extending in the longitudinal direction of the intermediate conveyor, and (e) a diverter plate (39) mounted below said slots at a descending angle to discharge misaligned cigarettes falling through the slots.

* * * * *